US006557670B2

(12) United States Patent
Wang

(10) Patent No.: US 6,557,670 B2
(45) Date of Patent: May 6, 2003

(54) DOUBLE BRAKE PROTECTION DEVICE FOR ELEVATOR

(76) Inventor: Jiun Jyh Wang, No. 50 Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 0 days.

(21) Appl. No.: 09/908,064

(22) Filed: Jul. 17, 2001

(65) Prior Publication Data

US 2003/0015377 A1 Jan. 23, 2003

(51) Int. Cl.[7] ..... B66B 1/06
(52) U.S. Cl. ..... 187/290; 187/378; 187/292
(58) Field of Search ..... 187/290, 358, 187/359, 362–366, 369–373, 376, 377, 372, 379, 272, 284, 285, 291, 292

(56) References Cited

U.S. PATENT DOCUMENTS

| | | | | | |
|---|---|---|---|---|---|
| 4,586,587 | A | * | 5/1986 | Grossi et al. | 187/293 |
| 4,987,977 | A | * | 1/1991 | Nomura | 187/288 |
| 5,025,896 | A | * | 6/1991 | Arabori et al. | 187/292 |
| 6,039,151 | A | * | 3/2000 | Ringel et al. | 187/207 |
| 6,196,355 | B1 | * | 3/2001 | Fargo et al. | 187/393 |
| 6,311,801 | B1 | * | 11/2001 | Takagi et al. | 187/290 |
| 2002/0117357 | A1 | * | 8/2002 | Hugel | |

* cited by examiner

*Primary Examiner*—Jonathan Salata
(74) *Attorney, Agent, or Firm*—Pro-Techtor International Services

(57) ABSTRACT

A double brake protection device for elevator is provided. The device comprises at least one of emergency means and electromagnetic means coupled to brake in order to effect a stepwise stopping procedure for preventing elevator from free falling after brake is released.

4 Claims, 5 Drawing Sheets

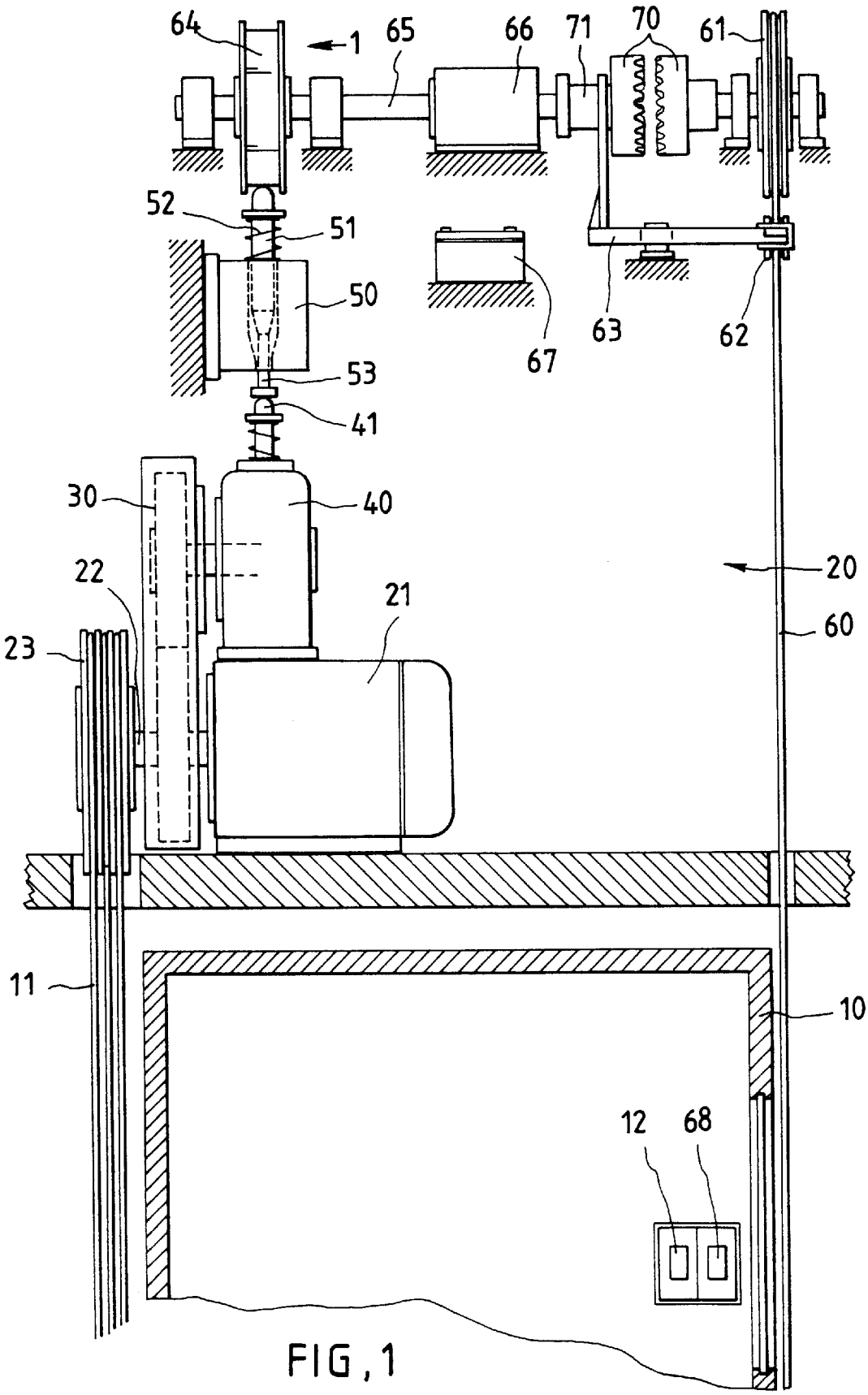
FIG, 1

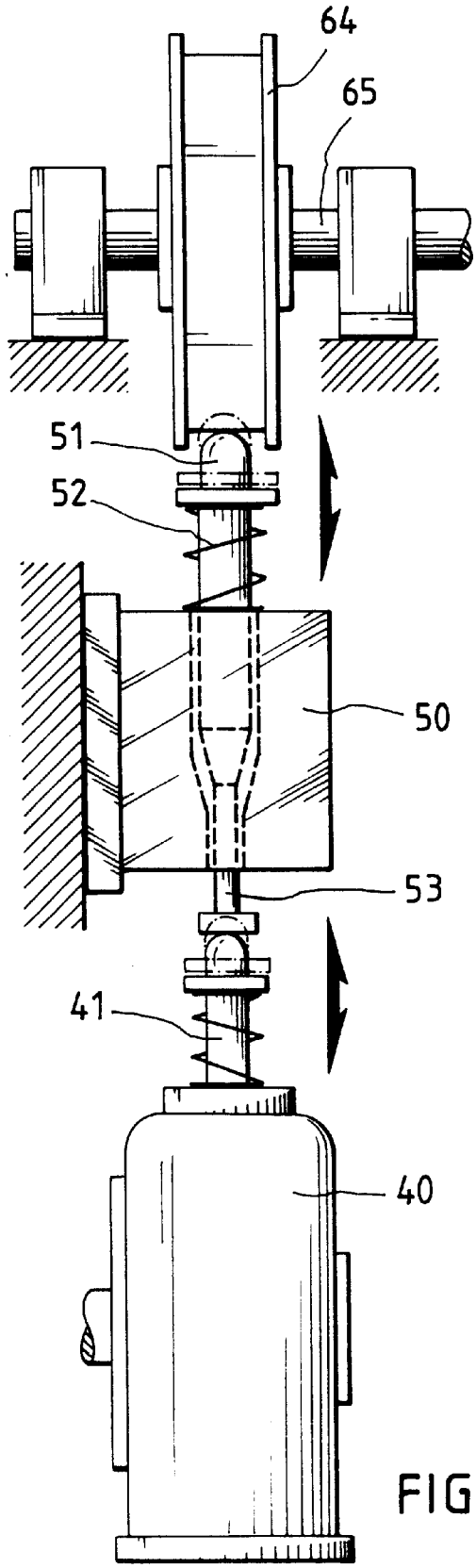
FIG, 2
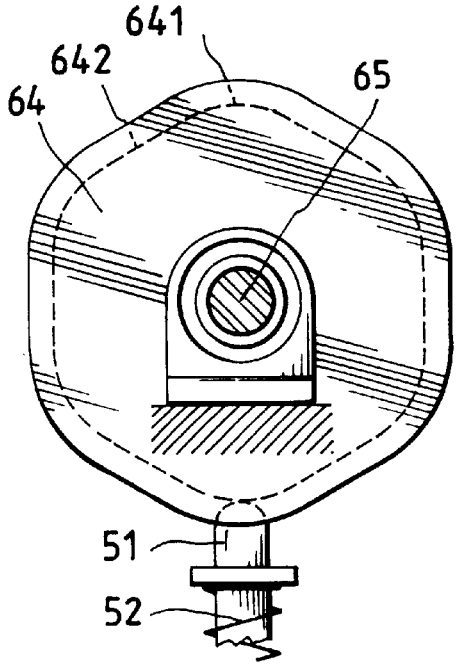
FIG, 6

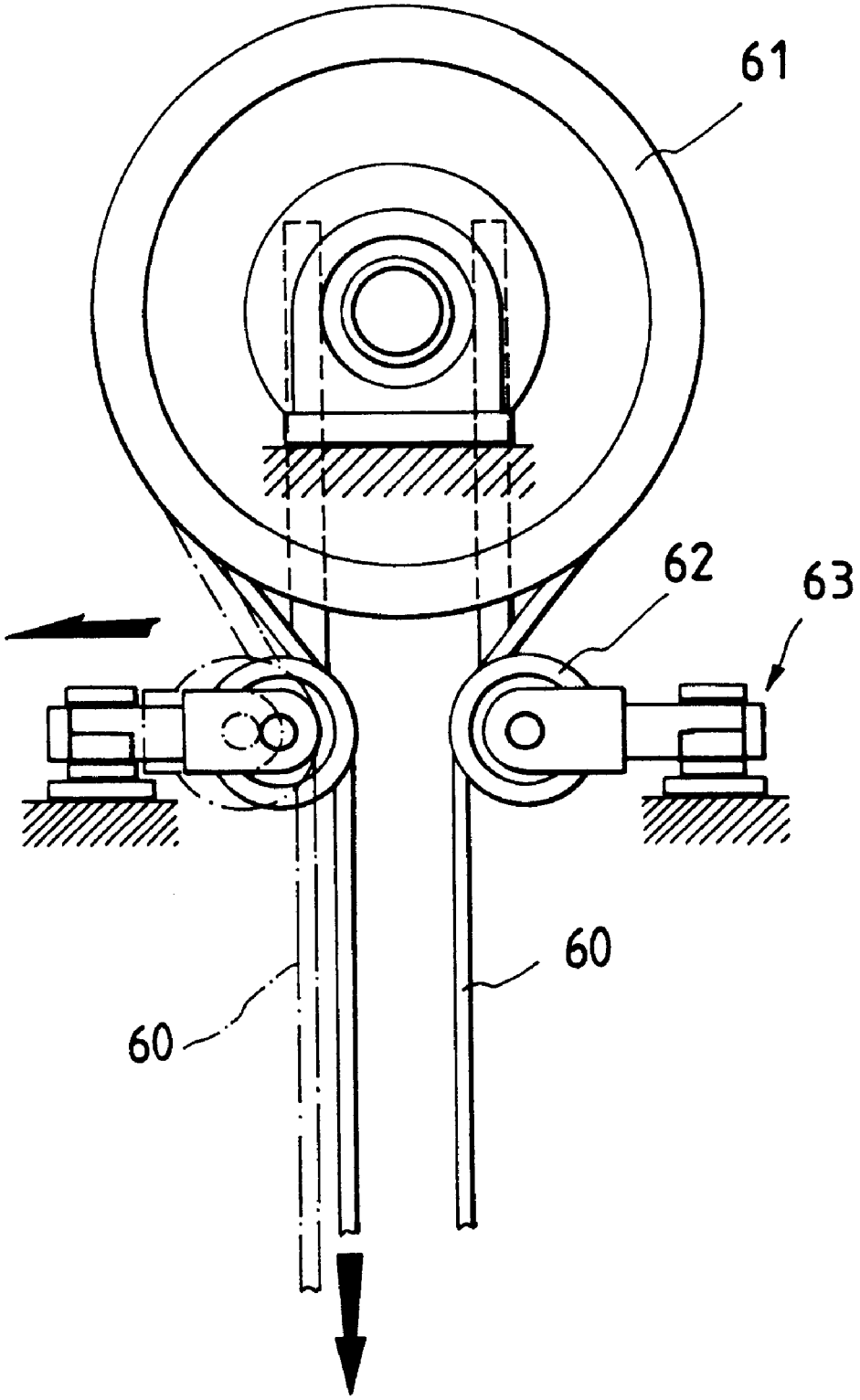
FIG, 3

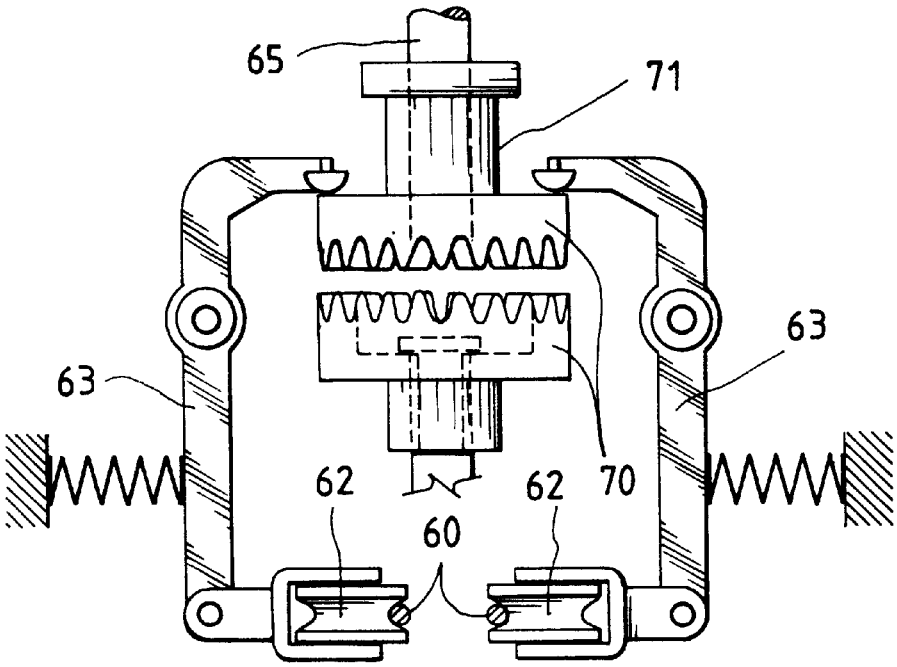
FIG, 4
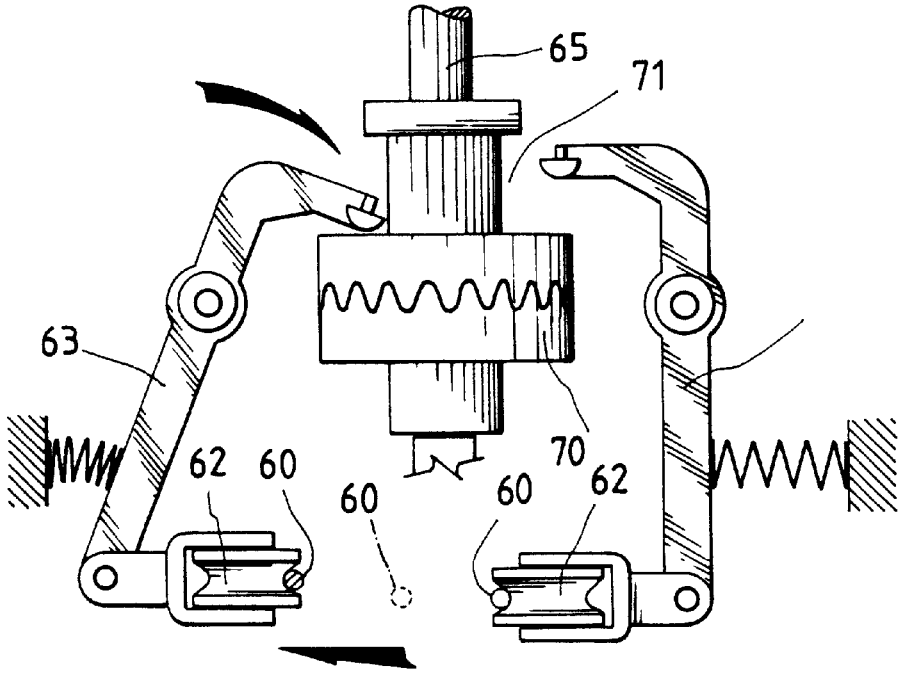
FIG, 5

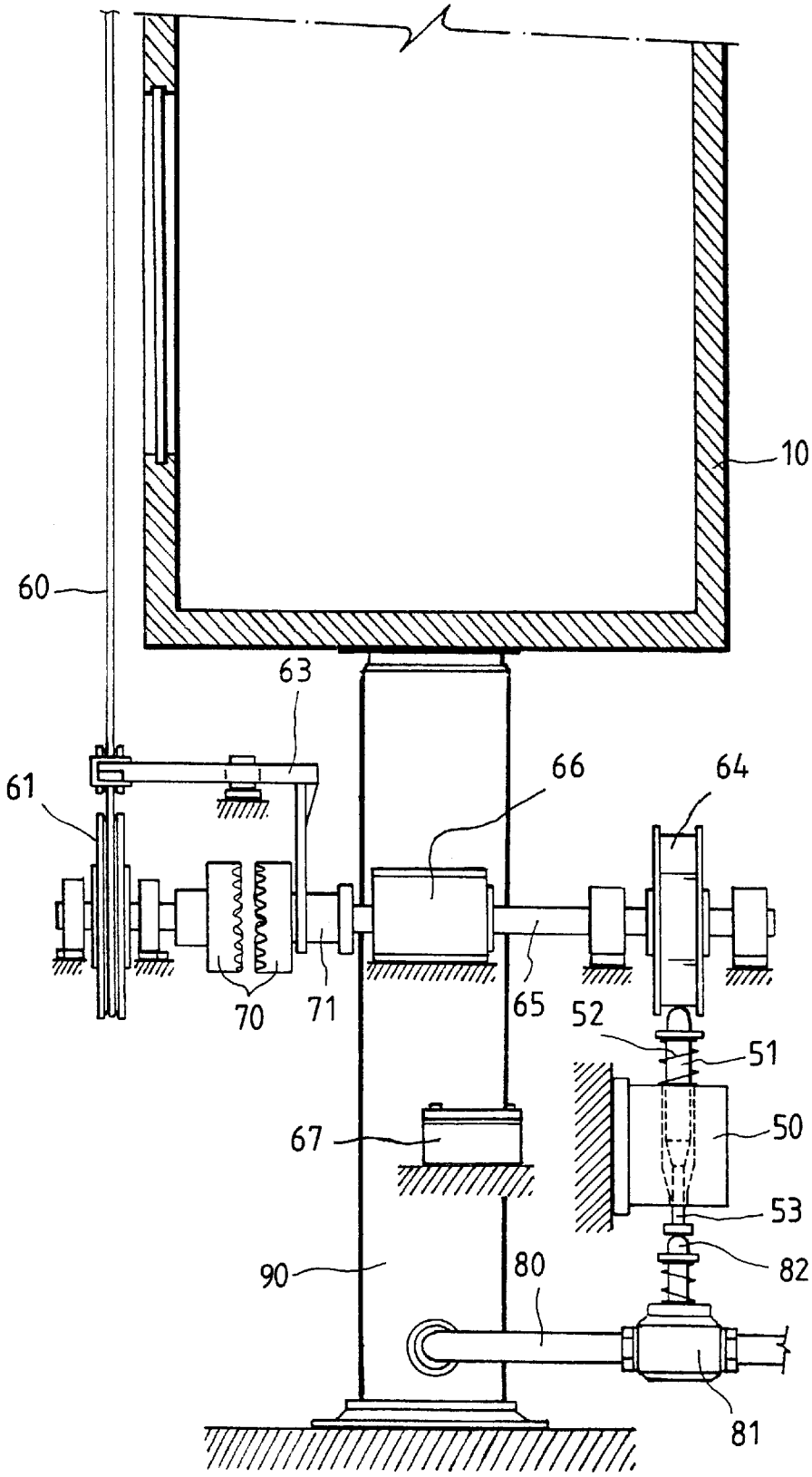
FIG,7

DOUBLE BRAKE PROTECTION DEVICE FOR ELEVATOR

FIELD OF THE INVENTION

The present invention relates to brakes and more particularly to a double brake protection device for elevator with improved characteristics.

BACKGROUND OF THE INVENTION

Conventionally, a counterweight is provided in an elevator for balance during running. However, such balance may be compromized when persons enter the car of elevator. This unbalanced condition (i.e., the weight of car is significantly heavier than that of counterweight) may be worsen after brake is released. As a result, car may fall suddenly due to law of gravitation. This may endanger the lives of persons in the car. Thus improvement exists.

SUMMARY OF THE INVENTION

It is therefore an object of the present invention to provide a brake protection device for an elevator comprising a main motor assembly including a first motor, a first shaft rotatably coupled to the first motor, a first sheave driven by the first shaft, a reduction gear coupled to the first shaft; a brake coupled to the main motor assembly, the brake including a rod-like spring-biased hand brake on the top; emergency means including a pair of idler wheels, a second sheave, a cable interconnecting the elevator and the second sheave through the idler wheels, a pair of pivotal link mechanisms coupled to the idler wheels, and a clutch having a recess coupled to one end of each link mechanism wherein the clutch is disengaged in a disabled state of the emergency means; and a secondary motor assembly coupled to the clutch, the secondary motor assembly including a second motor, a second shaft rotatably coupled to the second motor, and a third sheave coaxial with the second shaft, the third sheave having alternate peaks and valleys on a periphery in contact with the hand brake; wherein the cable is pulled to rotate the second sheave and the idler wheels; the link mechanisms are pivoted through a linking of the idler wheels for engaging the clutch; in response the third sheave rotates to cause the valleys and the peaks of the third sheave to engage with the hand brake alternately wherein when the hand brake is engaged with the peak of the third sheave, the hand break will be pulled down a predetermined distance for releasing the brake, or when the hand brake is engaged with the valley of the third sheave, the hand break will be pulled up the predetermined distance for applying the brake; and in response the elevator slows down stepwise until fully stops.

In one aspect of the present invention, the second motor is operated by battery means.

In another aspect of the present invention, the device further comprises an electromagnetic mechanism above the hand brake, the electromagnetic mechanism having a spring-biased lever extended therefrom, the lever being biased to its highest position in an unexcited state of the electromagnetic mechanism and an extension coupled to a bottom of the lever.

In a further aspect of the present invention, the electromagnetic mechanism is operated by either a backup power of a building or battery means.

The above and other objects, features and advantages of the present invention will become apparent from the following detailed description taken with the accompanying drawings.

BRIEF DESCRIPTION OF THE DRAWINGS

FIG. 1 is a side view in part section of a portion of elevator incorporating a double brake protection device according to the invention;

FIG. 2 is a fragmentary view of brake, electromagnetic device and sheave of FIG. 1;

FIG. 3 is a plan view of another sheave of FIG. 1;

FIG. 4 is a side view schematically showing link mechanism of FIG. 1 where clutch is disengaged;

FIG. 5 is a view similar to FIG. 4 where clutch is engaged;

FIG. 6 is a plan view of extension rod of FIG. 1; and

FIG. 7 is a side view in part section of a portion of elevator which is activated by a hydraulic device according to the invention.

DETAILED DESCRIPTION OF THE PREFERRED EMBODIMENTS

Referring to FIG. 1, there is shown a portion of an elevator incorporating a double brake protection device according to the invention. The elevator comprises a lower channel having a car 10 and a control including a first button 12 and a second button 68 within car 10; an upper control room 20 in which a variety of components are provided. These components comprise a motor 21, a shaft 22 rotatably coupled to motor 21, a drive sheave 23 driven by shaft 22, a reduction gear 30 meshed with a gear associated with shaft 22, a brake 40 coupled to reduction gear 30, brake 40 having an automatic brake releasing device and a spring-biased hand brake 41 in the shape of a rod extended from top, an electromagnetic device 50 as a life saving and protection device in a first embodiment including a lever 51 into the electromagnetic device 50, a spring 52 put on lever 51 biased against the top of electromagnetic device 50, and a lower extension rod 53 coupled to the bottom of lever 51. The operation of electromagnetic device 50 will now be described by referring to FIG. 2.

In FIG. 2, lever 51 is biased to its highest position by spring 52 in an unexcited state of electromagnetic device 50. Once electromagnetic device 50 is enabled, lever 51 will be pulled down to compress spring 52 until being stopped within electromagnetic device 50. Hence, hand brake 41 is pressed down to release the brake 40. As a result, car 10 will hoist or lower as the rotation of sheave 23 through a travelling cable 11 which interconnects car 10 and drive sheave 23. It is designed that once electromagnetic device 50 is enabled by pressing the first button 12 a predetermined number of on-off operations are continuously performed on electromagnetic device 50. Hence, a releasing and an application of the brake 40 are alternate. As a result, the running car 10 will slow down stepwise until fully stops in a desired level of a building. This can substantially eliminate the danger of sudden falling of brake experienced in prior art. Note that the power of electromagnetic device 50 is supplied by the backup power of the building or battery.

Alternatively, the life saving and protection device may be implemented by other members in a second embodiment as detailed below. Referring to FIGS. 3 to 5 in conjunction with FIG. 1, emergency cable 60 interconnects car 10 and sheave 61 through a pair of adjacent idler wheels 62 which are in turn coupled to link mechanisms 63. Link mechanism 63 is pivotably provided in control room 20. Further, one end of each link mechanism 63 is coupled to a recess 71 of clutch 70. In use, pull emergency cable 60 to rotate sheave 61 and thus idler wheels 62. In response, link mechanisms 63 are pivoted through the linking of idler wheels 62. As a result, clutch 70 is engaged.

Referring to FIG. 6 in conjunction with FIGS. 1 to 5, a secondary motor 66 powered by battery 67 is controlled by second button 68. Secondary motor 66 is coupled to shaft 65 which is coaxial with sheave 64. Hence, sheave 64 is rotated as shaft 65 is rotated by the pulling of emergency cable 60. Hence, hand brake 41 is pressed down to release the brake 40 through the activation of sheave 64 and electromagnetic device 50. In detail, the periphery of sheave 64 is formed of alternate smooth peaks 641 and valleys 642. Hence, lever 51 is biased to its highest position by spring 52 when lever 51 is engaged with valley 642 of sheave 64 in an unexcited state of electromagnetic device 50, while lever 51 is biased to its lowest position by spring 52 when lever 51 is engaged with peak 641 of sheave 64 for causing the electromagnetic device 50 to enter into an excited state. Similarly, once electromagnetic device 50 is enabled, hand brake 41 is pressed down to release the brake 40. As a result, car 10 will hoist or lower as the rotation of sheave 23 through the travelling cable 11. Likewise, a releasing and an application of the brake 40 are alternate. As a result, the running car 10 will slow down stepwise until fully stops in a desired level of a building. This has the same effect as the first embodiment described in FIGS. 1 and 2.

Referring to FIG. 7, there is shown a hydraulic elevator. The lower extension rod 53 is coupled to the top of rod 82 which is vertically extended from hydraulic cylinder 81. Also, sheave 64 is rotated as shaft 65 is rotated. When peak 641 of sheave 64 is engaged with lever 51, the lower extension rod 53 is activated by lever 51 to press the rod 82. As a result, fluid in fluid supply line 80 begins to flow as hydraulic cylinder 81 is activated by the pressing of rod 82. In response, fluid supplied to hydraulic shaft 90 of elevator activates for lowering car 10. Moreover, electromagnetic device 50 may be powered by battery 67 to cause the lower extension rod 53 to press the rod 82. This achieves the same effect of activating car 10 by sheave 64.

Note that a desired effect envisioned by the invention may be realized by one of the first, second and third embodiments or a combination thereof (as detailed in above illustrated embodiments). As to only second embodiment is realized (i.e., without the provision of electromagnetic device 50), sheave 64 may be provided on top of hand brake 41.

While the invention has been described by means of specific embodiments, numerous modifications and variations could be made thereto by those skilled in the art without departing from the scope and spirit of the invention set forth in the claims.

What is claimed is:

1. A brake protection device for an elevator comprising:

a main motor assembly including a first motor, a first shaft rotatably coupled to said first motor, a first sheave driven by said first shaft, a reduction gear coupled to said first shaft;

a brake coupled to said main motor assembly, said brake including a rod-like spring-biased hand brake on the top;

emergency means including a pair of idler wheels, a second sheave, a cable interconnecting said elevator and said second sheave through said idler wheels, a pair of pivotal link mechanisms coupled to said idler wheels, and a clutch having a recess coupled to one end of each link mechanism wherein said clutch is disengaged in a disabled state of said emergency means; and a secondary motor assembly coupled to said clutch, said secondary motor assembly including a second motor, a second shaft rotatably coupled to said second motor, and a third sheave coaxial with said second shaft, said third sheave having alternate peaks and valleys on a periphery in contact with said hand brake;

wherein said cable is pulled to rotate said second sheave and said idler wheels; said link mechanisms are pivoted through a linking of said idler wheels for engaging said clutch; in response said third sheave rotates to cause said valleys and said peaks of said third sheave to engage with said hand brake alternately wherein when said hand brake is engaged with said peak of said third sheave, said hand break will be pulled down a predetermined distance for releasing said brake, and when said hand brake is engaged with said valley of said third sheave, said hand break will be pulled up said predetermined distance for applying said brake; and in response said elevator sows down stepwise until said elevator fully stops.

2. The device of claim 1, wherein said second motor is operated by battery means.

3. The device of claim 1, further comprising an electromagnetic mechanism above said hand brake, said electromagnetic mechanism having a spring-biased lever extended therefrom, said lever being biased to its highest position in an unexcited state of said electromagnetic mechanism and an extension coupled to a bottom of said lever.

4. The device of claim 3, wherein said electromagnetic mechanism is operated by either a backup power of a building or battery means.

* * * * *